United States Patent [19]

Ury et al.

[11] Patent Number: 4,695,757

[45] **Date of Patent: * Sep. 22, 1987**

[54] METHOD AND APPARATUS FOR COOLING ELECTRODELESS LAMPS

[75] Inventors: Michael G. Ury, Bethesda; Charles H. Wood, Rockville, both of Md.

[73] Assignee: Fusion Systems Corporation, Rockville, Md.

[ * ] Notice: The portion of the term of this patent subsequent to Nov. 27, 2001 has been disclaimed.

[21] Appl. No.: 674,631

[22] Filed: Nov. 26, 1984

Related U.S. Application Data

[63] Continuation-in-part of Ser. No. 381,481, May 24, 1982, Pat. No. 4,485,332.

[30] Foreign Application Priority Data

Dec. 5, 1983 [JP] Japan ..... 58-229730

[51] Int. Cl.[4] ..... H01J 7/24; H01J 61/52

[52] U.S. Cl. ..... 313/44; 315/112

[58] Field of Search ..... 313/44, 12, 13; 315/112

[56] References Cited

U.S. PATENT DOCUMENTS

| | | | |
|---|---|---|---|
| 3,786,308 | 1/1974 | Browner et al. | 313/44 X |
| 3,978,361 | 8/1976 | Hiramoto | 313/44 X |
| 3,989,983 | 11/1976 | Uchino et al. | 313/44 X |
| 4,485,332 | 11/1984 | Ury et al. | 315/248 X |

*Primary Examiner*—David K. Moore
*Assistant Examiner*—K. Wieder
*Attorney, Agent, or Firm*—Pollock, Vande Sande & Priddy

[57] ABSTRACT

A method of cooling the lamp envelope of an electrodeless lamp by directing a stream of cooling gas at the envelope while providing relative rotation between the lamp envelope and the stream of cooling gas. The relative rotation can be achieved by rotating the envelope, or the source of cooling gas, or both.

8 Claims, 3 Drawing Figures

METHOD AND APPARATUS FOR COOLING ELECTRODELESS LAMPS

This application is a continuation in part of application Ser. No. 381,481, filed May 24, 1982 now U.S. Pat. No. 4,485,332.

The present invention is directed to a method and apparatus for cooling electrodeless lamps.

The electrodeless lamps with which the present invention is concerned are generally comprised of a lamp envelope containing a plasma forming medium. To operate the lamps, the medium in the envelope is excited, with microwave, R.F., or other electromagnetic energy, thereby generating a plasma, which emits radiation in the ultraviolet, visible or infrared part of the spectrum. Important uses for such electrodeless lamps to date are in the curing of coatings or inks by photopolymerization reaction, and in photolithography.

It is known that electrodeless lamps transfer a great deal of heat to the envelopes during operation, and it has been found that the effectiveness with which the lamp envelopes may be cooled is a limiting factor in overall lamp performance. Thus, the brightness with which energy is radiated by the lamp increases with the power density of the microwave or other energy in the lamp envelope, but as the power density inreases, so does envelope temperature, with a point being reached where the envelope melts if not adequately cooled. Thus, the brightness which can be obtained from the lamp is ultimately a function of cooling. Also, in the case where a lamp is operating satisfactorily at a given envelope temperature, cooling the envelope further has the effect of substantially increasing bulb lifetime.

The conventional technique for cooling electrodeless lamps is to push or pull air over the stationary lamp envelope. In the conventional positive forced air system, illustrated in U.S. Pat. No. 4,042,850, air from a compressor is pushed into the lamp chamber over the lamp envelope, while in the negative or vacuum type system, air is withdrawn from the chamber over the lamp envelope.

It has been found that the cooling which is afforded by the conventional forced air system is quite limited, which places a limit on the power density at which the lamp can be operated, and therefore also on lamp brightness. The limitations of the conventional cooling system are discussed in Japanese Published Application No. 55-154097 by Yoshio Yasaki, which states that a power density of 100 watts/cm$^3$ is a limit using forced air, since higher densities cause the lamp envelope to break, and in order to attain a brighter source Yasaki proposes a system wherein the lamp envelope is immersed in water during operation.

It is thus an object of the present invention to provide an improved method and apparatus for cooling electrodeless lamps.

It is a further object of the invention to provide electrodeless lamps which are capable of operating at relatively high power densities.

It is still a further object of the invention to provide electrodeless lamps which are relatively bright.

It is still a further object of the invention to provide electrodeless lamps having a relatively long lifetime.

It is still a further object of the invention to cool an electrodeless lamp without having to immerse the lamp in water.

In accordance with the invention, the above objects are attained by providing relative rotative motion between the lamp envelope and streams of cooling gas which are directed thereat. As the rotative motion occurs, adjacent surface portions of the envelope sequentially appear in the direct path of the stream or streams with the result that the entire surface area is adequately cooled. Using this technique, it has been found that the average surface temperature of a cylindrical envelope was reduced from 850° C. using conventional cooling to approximately 650° C.

In particular, the streams of cooling gas may be rotated around the bulb or may be oscillated without effecting complete rotation. In a further embodiment both the gas streams and bulb envelope are rotated.

The invention will be better appreciated by referring to the accompanying figures in which.

Figure 1:
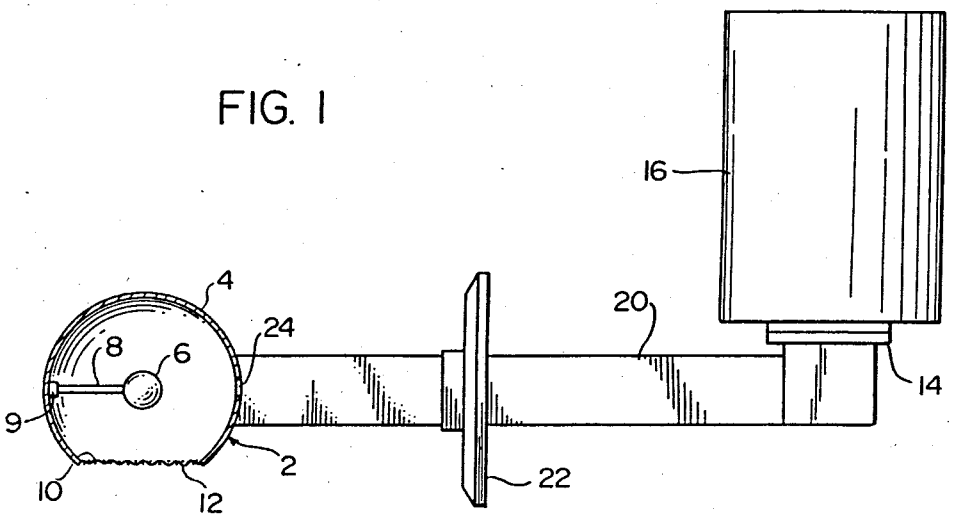
FIG. 1 is a schematic illustration of an electrodeless lamp to be cooled by the method and apparatus of the invention.

Referring to FIG. 1, microwave generated electrodeless light source 2 is depicted.

Light source 2 is comprised of spherical lamp envelope 6 and spherical microwave chamber 4 in which the envelope is disposed. The lamp envelope is typically made of quartz while the chamber is made of a conductive material such as copper or aluminum, and the envelope is held at the center of the chamber by mounting stem 8 which is secured to the chamber wall by flange 9. Chamber 4 has a circular aperture 10 for emitting light which is covered with conductive mesh 12 which is effective to retain microwave energy in the chamber while allowing the ultraviolet light emitted by lamp envelope 6 to escape. While the particular light source illustrated employs a spherical microwave chamber, such chamber can be of various shapes.

Lamp envelope 6 is filled with a plasma forming medium, for example, mercury in a noble gas. When excited with microwave energy, this medium becomes a hot plasma which emits ultraviolet radiation. The microwave energy is supplied by magnetron 14 which is powered by electrical power supply 16. The microwave energy emitted by the magnetron is coupled to chamber 4 by rectangular waveguide section 20, and coupling is optimized by tuning stub 22. Chamber 4 has a rectangular slot 24 therein for admitting the microwave energy to the chamber and exciting the plasma in envelope 6.

In order for the lamp depicted in FIG. 1 to attain the required brightness, microwave energy at a power density of several hundred watts/cm$^3$ must be coupled to the medium in envelope 6. As mentioned above, this causes the envelope to become extremely hot, and if adequate cooling is not provided, the envelope will melt, and ultimately break. This was precisely the result when the lamp depicted in FIG. 1 was cooled by the conventional forced air system of the prior art.

In accordance with the cooling method and apparatus of the present invention, the streams of cooling gas are rotated about the lamp envelope. As the rotation occurs, adjacent surface portions of the envelope sequentially appear in the direct path of the stream or streams and thereby experience maximum cooling effect from the streams, with the result that the entire surface area is adequately cooled. A great improvement results over the prior art system in which a stationary stream of cooling gas is directed at a stationary lamp.

Figure 3:
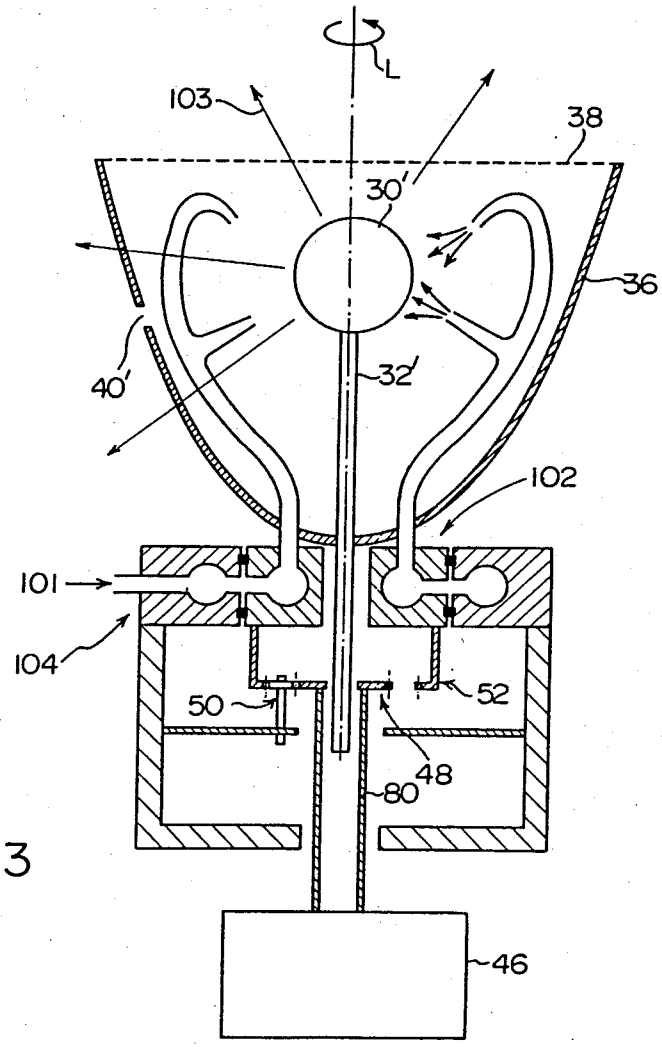
FIGS. 2 and 3 are schematic illustrations of embodiments of the invention.
Figure 2:
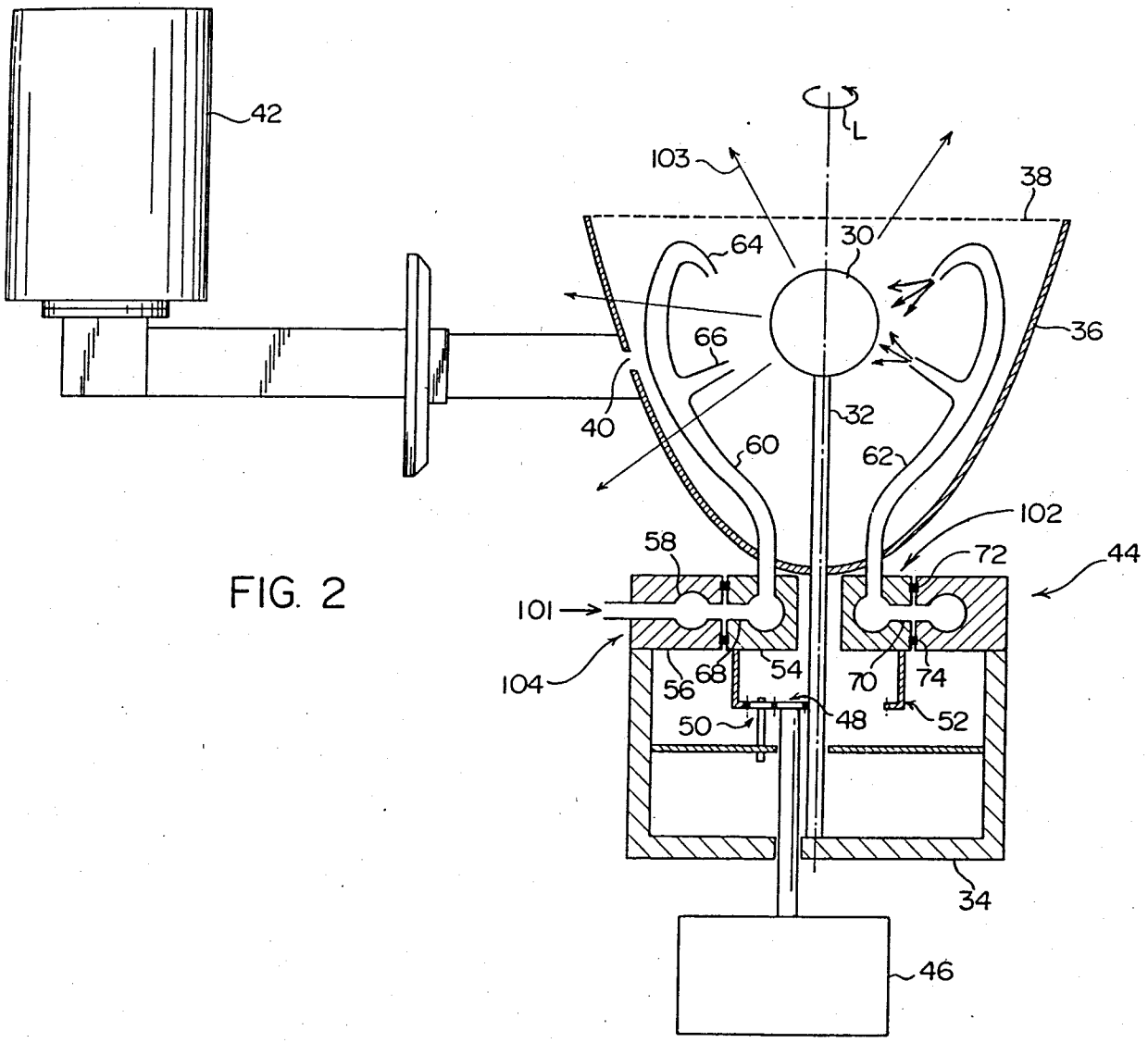

FIGS. 2 and 3 are schematic illustrations of embodiments of the improved cooling system of the invention.

Referring to FIG. 2, an electrodeless lamp having spherical lamp envelope 30 is shown. The envelope is secured to stem 32 which at the other end is secured to fixed member 34. The lamp envelope is disposed in a microwave chamber comprised of parabolic reflector 36 and planar mesh 38. Reflector 36 has a slot 40 therein, and microwave energy from magnetron 42 is fed through waveguide 44 and through slot 40 to the interior of the microwave chamber.

In order to cool lamp envelope 30, assembly 44 is provided. Assembly 44 includes drive motor 46, the shaft of which rotates drive gear 48. Drive gear 48 rotates idler gear 50, which in turn rotates driven gear 52.

A rotating seal comprised of rotating portion 54 and stationary portion 56 is provided. Fixed manifold 58 is disposed in stationary seal portion 56 and cooling gas is fed under pressure to the fixed manifold. It is to be understood that the assembly depicted in FIG. 2 is in cross section and the geometry of the rotating seal and the manifold is cylindrical.

Rotating cooling fluid source means in the form of conduits 60 and 62 are provided, and each has as a part thereof a plurality of nozzles such as 64 and 66 which are directed towards the lamp envelope. The conduits terminate in termination portions 68 and 70 which are within the rotating portion of the rotating seal. As seal portion 54 rotates, it rotates conduits 60 and 62, while cooling fluid is continuously supplied to the conduits during rotation, as termination portions 68 and 70 continue to be supplied with fluid from manifold 58 as they rotate. O-rings 72 and 74 serve to seal the fluid passageways from the exterior. An actual embodiment may include more than two cooling fluid conduits, for example, greater cooling action would be obtained with four fluid conduits.

In the embodiment shown in FIG. 2, the fluid conduits would be rotated at a relatively rapid rate to attain maximum cooling effect. It is to be understood that the conduits need not be rotated completely around the envelope, but can be oscillated about a fixed location. Stationary cooling nozzles may have the effect of casting an undesired shadow on the light output. In addition to providing superior cooling, rotating the nozzles as in the present invention has the effect of evening out the shadow cast by the nozzles, making it much less objectionable.

The embodiment shown in FIG. 3 is identical to that of FIG. 2, except that both the lamp envelope and the fluid nozzles rotate. Thus, in FIG. 3 stem 32' of lamp envelope 30' is rotated by the motor shaft 80. This embodiment may be arranged so that the lamp envelope rotates at a relatively rapid rate while the nozzles rotate at a relatively slow rate.

It should be appreciated that while the invention has been disclosed in connection with a preferred embodiment illustrating a particular electrodeless lamp, it may be used to cool all types of electrodeless lamps including envelopes of cylindrical, toroidal, and other geometry.

Further, it should be understood that many variations which fall within the scope of the invention may occur to those skilled in the art, and the scope of the invention is limited solely by the claims appended hereto, and equivalents.

We claim:

1. A method of cooling an electrodeless lamp having a lamp envelope which gets extremely hot during operation, comprising the steps of, providing a source which produces at least a stream of cooling gas under pressure, directing said at least a stream of cooling gas at said lamp envelope, and providing relative rotative motion between said lamp envelope and said source, wherein said relative rotative motion comprises rotating said source completely about said envelope.

2. A method of cooling an electrodeless lamp having a lamp envelope which gets extremely hot during operation, comprising the steps of, providing a source which produces at least a stream of cooling gas under pressure, directing said at least a stream of cooling gas at said lamp envelope, and providing relative rotative motion between said lamp envelope and said source, wherein said relative rotative motion comprises rotating said source about said envelope incompletely in one direction and then incompletely in the opposite direction so that said source oscillates about a given position.

3. The method of claim 1 or 2 wherein said electrodeless lamp comprises a microwave generated plasma lamp.

4. An apparatus for cooling an electrodeless lamp having a lamp envelope which gets extremely hot during operation comprising, source means for providing at least a stream of cooling gas under pressure said source means including conduit means for directing said at least a stream of cooling gas at said lamp envelope, and means for providing relative rotative motion between said lamp envelope and said conduit means.

5. The apparatus of claim 4 wherein said means for providing relative rotative motion comprises, means for rotating said conduit means completely about said envelope.

6. The apparatus of claim 4 wherein said means for providing relative rotative motion comprises means for rotating said conduit mwans incompletely in one direction and then incompletely in the opposite direction so that said conduit means oscillates about a given position.

7. The apparatus of claim 4 wherein said means for providing said relative rotative motion comprises means for providing rotative motion to both said lamp envelope and said conduit means.

8. The apparatus of claim 4 wherein said means for providing relative rotative motion includes rotating seal means comprised of a stationary part and a movable part.

* * * * *

UNITED STATES PATENT AND TRADEMARK OFFICE

CERTIFICATE OF CORRECTION

PATENT NO. : 4,695,757

DATED : September 22, 1987

INVENTOR(S) : Ury, et al.

It is certified that error appears in the above-identified patent and that said Letters Patent is hereby corrected as shown below:

In column 4, claim 6, line 51 should read:

--rotating said conduit means incompletely in one direc- --

Signed and Sealed this

Third Day of January, 1989

*Attest:*

DONALD J. QUIGG

*Attesting Officer*

*Commissioner of Patents and Trademarks*